US009435535B2

(12) United States Patent
Desai et al.

(10) Patent No.: US 9,435,535 B2
(45) Date of Patent: Sep. 6, 2016

(54) COMBUSTION LINER GUIDE STOP AND METHOD FOR ASSEMBLING A COMBUSTOR

(75) Inventors: Anand Prafulchandra Desai, Bangalore (IN); Praveen Kumar Tiwari, Bangalore (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1089 days.

(21) Appl. No.: 13/400,264

(22) Filed: Feb. 20, 2012

(65) Prior Publication Data

US 2013/0213047 A1 Aug. 22, 2013

(51) Int. Cl.
*F23R 3/00* (2006.01)
*F23R 3/60* (2006.01)

(52) U.S. Cl.
CPC ..... *F23R 3/002* (2013.01); *F23R 3/60* (2013.01); *F23R 2900/00017* (2013.01); *Y10T 29/49231* (2015.01)

(58) Field of Classification Search
CPC ..... F23R 3/00; F23R 3/002; F23R 3/02; F23R 3/42; F23R 3/44; F23R 3/50; F23R 3/60
USPC ..... 60/796, 798, 799, 800, 752, 753, 754, 60/755, 756, 757, 758, 759, 760
See application file for complete search history.

(56) References Cited

U.S. PATENT DOCUMENTS 3,116,606 A 1/1964 Dougherty et al.
3,372,542 A 3/1968 Sevetz
3,481,316 A 12/1969 Olson et al.
3,911,672 A * 10/1975 Irwin ..... F23R 3/007 60/753
4,195,476 A * 4/1980 Wood ..... F23R 3/42 60/737
4,903,476 A * 2/1990 Steber ..... F23R 3/283 431/264
5,323,600 A 6/1994 Munshi
5,524,430 A * 6/1996 Mazeaud ..... F23R 3/283 60/752
6,216,442 B1 4/2001 Belsom et al.
6,279,313 B1 8/2001 Lawen, Jr. et al.
6,324,830 B1 * 12/2001 Spooner ..... F23R 3/60 60/740
6,331,110 B1 * 12/2001 Steber ..... F01D 9/023 431/10
6,341,485 B1 * 1/2002 Liebe ..... F23R 3/002 60/760
6,415,610 B1 * 7/2002 Parker ..... F01D 25/28 60/748

(Continued)

FOREIGN PATENT DOCUMENTS

CN 1590850 A 3/2005
CN 1828140 A 9/2006

(Continued)

OTHER PUBLICATIONS

European Search Report and Opinion issued in connection with corresponding EP Application No. 13155371.1 on Sep. 18, 2015.

(Continued)

*Primary Examiner* — Gerald L Sung
*Assistant Examiner* — Scott Walthour
(74) *Attorney, Agent, or Firm* — Dority & Manning, PA

(57) ABSTRACT

A combustor for a gas turbine including a casing, a flow sleeve at least partially disposed within the casing, a combustion liner at least partially disposed within the flow sleeve, a liner stop feature extending from the combustion liner, and a liner guide stop including a first end separated from a second end, the second end configured to be at least partially engaged with the liner stop feature, wherein the liner guide stop extends through the casing and the flow sleeve.

11 Claims, 5 Drawing Sheets

(56) References Cited

U.S. PATENT DOCUMENTS

| | | | | |
|---|---|---|---|---|
| 6,843,061 | B2 * | 1/2005 | Parker | F02C 9/28 60/772 |
| 7,082,766 | B1 | 8/2006 | Widener et al. | |
| 7,555,906 | B2 | 7/2009 | Anichini et al. | |
| 7,571,611 | B2 | 8/2009 | Johnson et al. | |
| 7,647,779 | B2 | 1/2010 | Shi et al. | |
| 7,762,075 | B2 | 7/2010 | Pangle et al. | |
| 8,303,243 | B2 * | 11/2012 | Fish | F02C 3/305 244/53 R |
| 2002/0189260 | A1 * | 12/2002 | David | F23R 3/045 60/746 |
| 2004/0118127 | A1 | 6/2004 | Mitchell et al. | |
| 2005/0150233 | A1 * | 7/2005 | Glessner | F16B 5/0208 60/796 |
| 2006/0168967 | A1 * | 8/2006 | Simons | F23C 6/047 60/772 |
| 2006/0174631 | A1 * | 8/2006 | Parker | F23R 3/14 60/796 |
| 2007/0119180 | A1 * | 5/2007 | Zigan | F01D 25/285 60/796 |
| 2007/0119181 | A1 * | 5/2007 | Lohmueller | F01D 25/28 60/796 |
| 2007/0119182 | A1 * | 5/2007 | Czachor | F01D 25/28 60/796 |
| 2009/0255268 | A1 * | 10/2009 | Kaleeswaran | F23R 3/002 60/757 |
| 2010/0180602 | A1 | 7/2010 | Johnson et al. | |
| 2012/0036857 | A1 * | 2/2012 | Bassani | F23R 3/60 60/752 |
| 2014/0090399 | A1 * | 4/2014 | McAlice | F02K 1/82 60/796 |
| 2014/0352323 | A1 * | 12/2014 | Bennett | F02C 7/28 60/799 |

FOREIGN PATENT DOCUMENTS

| | | | |
|---|---|---|---|
| CN | 1854611 | A | 11/2006 |
| CN | 101063422 | A | 10/2007 |
| CN | 202101276 | U | 1/2012 |
| EP | 1793095 | A1 | 6/2007 |

OTHER PUBLICATIONS

Unofficial English translation of Chinese Office Action issued in connection with corresponding CN Application No. 201310054795.X on Dec. 17, 2015.

* cited by examiner

COMBUSTION LINER GUIDE STOP AND METHOD FOR ASSEMBLING A COMBUSTOR

FIELD OF THE INVENTION

The present subject matter relates generally to a combustion liner guide stop of gas turbine combustor, and particularly to combustion liner guide stop inserted through a combustor casing and a method for assembling the combustor.

BACKGROUND OF THE INVENTION

Gas turbines typically include a compressor section, a combustion section, and a turbine section. The compressor section pressurizes air flowing into the turbine. The pressurized air discharged from the compressor section flows into the combustion section, which is generally characterized by a plurality of combustors disposed around an annular array about the axis of the gas turbine. Each of the plurality of combustors includes a combustion liner, which defines the combustion chamber of the combustor. As such, air entering each combustor is mixed with fuel and combusted within the combustion liner. Hot combustion gases flow from the combustion liner through a transition piece to the turbine section of the gas turbine to drive the turbine and generate power.

The combustion liner is typically concentrically located within a flow sleeve of the combustor and radially inwardly spaced therefrom. The forward end of the combustion liner is generally provided with a plurality of circumferentially spaced liner stop features (i.e., male or female liner stops) which engage and/or mate with a corresponding number of liner guide stops typically secured to the flow sleeve. As such, when the combustion liner is installed within the flow sleeve, the liner stops ensure proper radial and axial location of the combustion liner within the flow sleeve and also prevent the combustion liner from moving in an axially downstream direction (i.e., towards the transition piece).

During operation, combustor dynamics and thermal stresses may cause the combustion liner, the flow sleeve and other components of the combustor to vibrate and otherwise move with respect to one another. This can lead to failure of the liner stop features and/or the liner guide stops, thereby resulting in misalignment of the combustion liner within the flow sleeve and/or damage to the combustion liner or flow sleeve. In order to repair the damaged liner guide stops, the combustor must be taken offline and at least partially disassembled. The combustion liner and/or the flow sleeve have to be removed and a worker must machine the damaged component on site, or send the parts off-site for repair resulting in costly repairs and extended outage periods. Accordingly, an improved combustor liner guide stop for a gas turbine combustor and a method for installing the liner guide stop would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter discloses a combustor for a gas turbine. The combustor includes a casing, a flow sleeve at least partially disposed within the casing, a combustion liner at least partially disposed within the flow sleeve, a liner stop feature extending from the combustion liner, and a liner guide stop. The liner guide stop includes a first end separated from a second end. The second end may be configured to at least partially engage the liner stop feature, and the liner guide stop extends through the casing and the flow sleeve.

In another aspect, the present subject matter discloses a method for assembling a combustor of a gas turbine, the combustor including a casing, a flow sleeve and a combustion liner. The method generally includes inserting the combustion liner into the combustor casing, wherein the combustion liner includes at least one liner stop feature extending from the combustion liner. The method may also include inserting a liner guide stop through the casing and the flow sleeve, wherein the liner guide stop extends between a first end and a second end, and engaging the second end of the liner guide stop with the liner stop feature.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
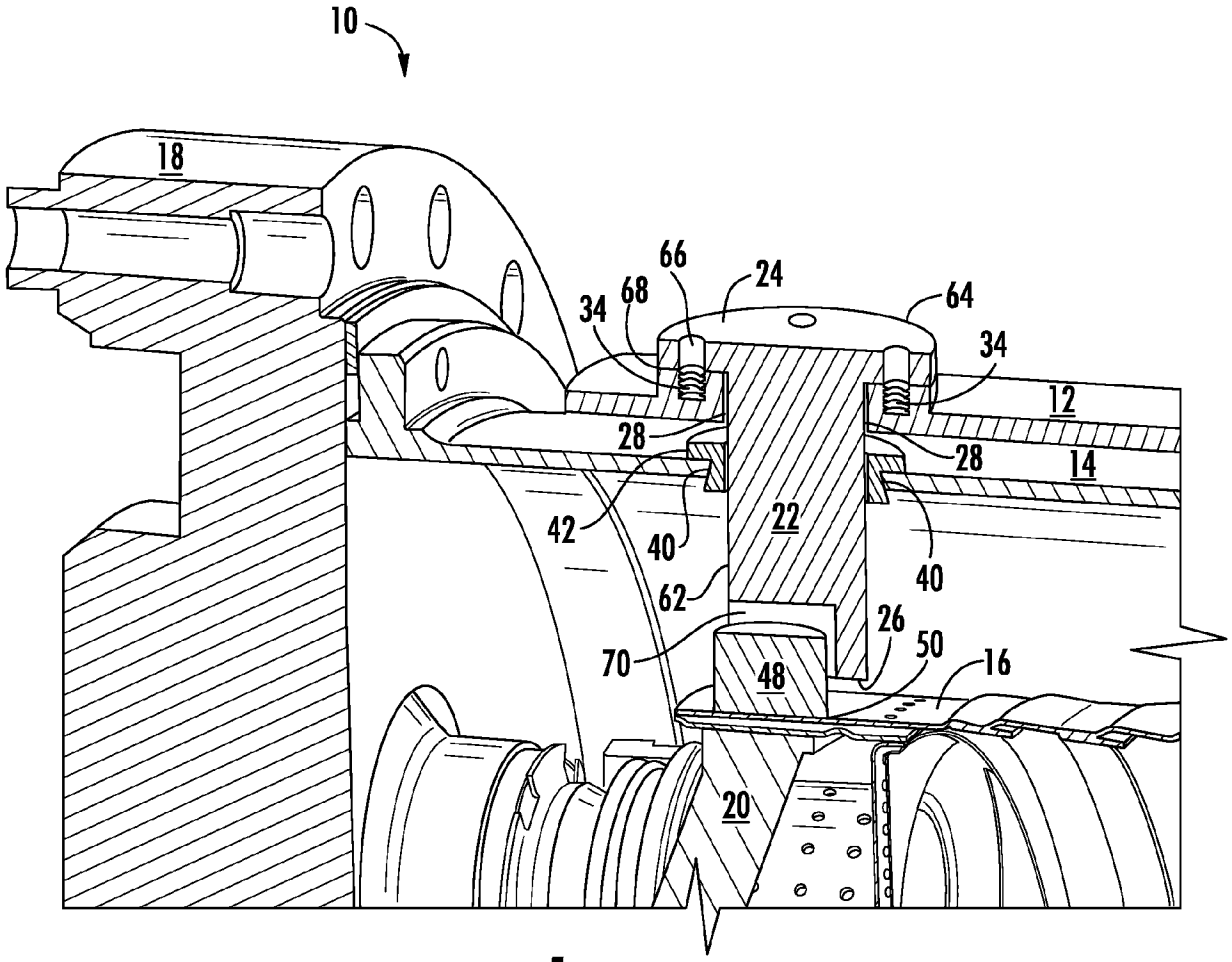
FIG. 1 illustrates a cross-sectional side view of a portion of a gas turbine combustor according to various embodiments of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present subject matter is generally directed to a gas turbine combustor including a casing, a flow sleeve, a combustion liner and a liner guide stop. The present subject matter is also directed to a method for assembling the combustor. In various embodiments the liner guide stop passes through the casing and the flow sleeve and engages with a liner stop feature extending generally radially from the combustion liner. As a result, the combustion liner may be properly aligned and supported within the combustor during assembly and operation of the combustor. In particular embodiments, the liner guide stop may be coupled to an outer surface of the casing. In this manner, the liner guide stop may be removed and/or replaced through the casing without requiring disassembly of the combustor, thereby saving operators considerable expenses, such as labor and material and lost revenue costs generally associated with extended outages. In addition, by passing the liner guide stop through the casing and the flow sleeve rather than mechanically coupling it directly to the flow sleeve, mechanical and thermal stresses may be significantly reduced on the flow sleeve. As a result, the period between outages may be extended, thus further reducing operating expenses incurred by operators.

Referring now to the drawings, FIGS. 1-4 illustrate cross-sectional side views of a portion of a gas turbine combustor 10 according to various embodiments of the present invention. As shown in FIG. 1, the combustor 10 may include a generally annular casing 12. The casing 12 may be secured to a portion of a gas turbine casing (not shown), such as a compressor discharge casing or a combustion wrapper casing. The combustor 10 may also include a flow sleeve 14 and a combustion liner 16 substantially concentrically arranged within the flow sleeve 14. The combustor 10 may further include an end cover 18 disposed at one end of the casing 12 and may also include a fuel nozzle cap assembly 20 disposed generally within the combustion liner 16. The combustor 10 may also include at least one liner guide stop 22 including a first end 24 and a second end 26. The combustion liner 16 may generally define a substantially cylindrical combustion chamber, wherein fuel and air are injected and combusted to produce hot gases of combustion.

Figure 2:
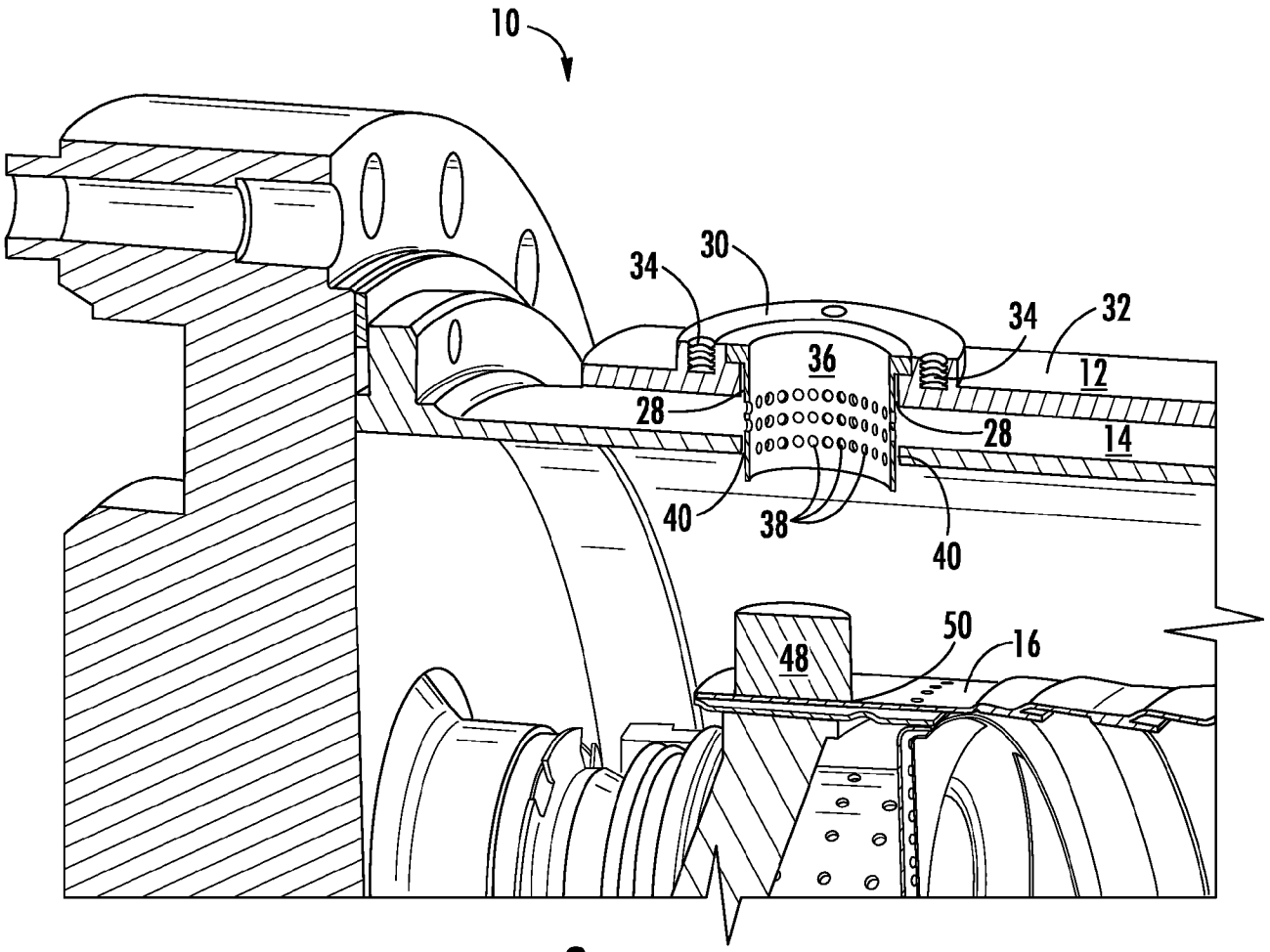
FIG. 2 illustrates a cross-sectional side view of the gas turbine combustor as shown in FIG. 1.
Figure 3:
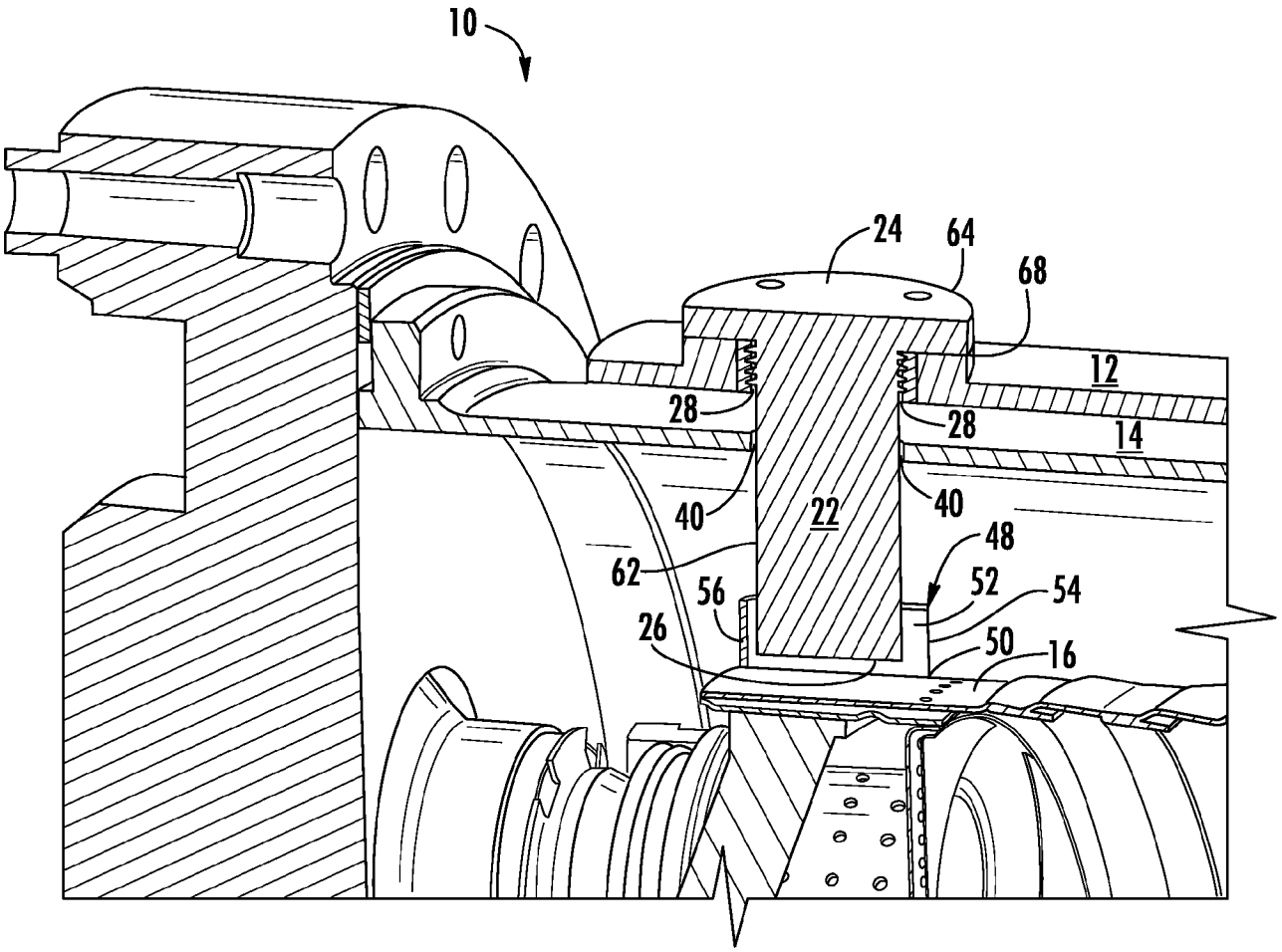
FIG. 3 illustrates a cross-sectional side view of the gas turbine combustor as shown in FIG. 1.

As shown in FIG. 2, the casing 12 may define at least one first passage 28 extending generally radially through the casing 12. The casing 12 may also define a first mating surface 30 disposed on an outer surface 32 of the casing 12. The first mating surface 30 may at least partially surround the first passage 28. The first mating surface 30 and/or the casing 12 may be configured to receive a complementary threaded fastener, such as a bolt (not shown). For example, the first mating surface 30 may include at least one recess 34 extending generally radially inward from the first mating surface 30. In particular embodiments, the recess 34 may be tapped and/or may be configured to receive a threaded insert. In further embodiments, the first passage 28 may be configured to allow the liner guide stop 22 to be coupled directly to the casing 12. For example, in particular embodiments, as shown in FIG. 3, the first passage 28 may be tapped and/or configured to receive a threaded insert.

As shown in FIG. 2, a first collar 36 may be disposed substantially concentrically within the first passage 28. The first collar 36 may extend generally radially inward and through the casing 12. The first collar 36 may at least partially surround the liner guide stop 22 shown in FIGS. 1, 3 and 4. In particular embodiments, the first collar 36 may extend through the casing 12 and the flow sleeve 14. The first collar 36 may be generally arcuate, rectangular, triangular and/or any shape complementary to the first passage 24. In this manner, the first collar 36 may prevent the liner guide stop 22 from damaging the first passage 28 and/or the flow sleeve 14 during assembly and operation of the combustor 10 by providing a boundary surface between the liner guide stop 22 and the casing 12 and/or the flow sleeve 14. In addition, the first collar 36 may help to guide the liner guide stop 22 through the casing 12 and/or the flow sleeve 14 during assembly of the combustor 10. In further embodiments, the first collar 36 may at least partially define a plurality of cooling passages 38 extending therethrough. In this manner, a working fluid, such as compressor discharge air, may flow through the plurality of cooling passages 38 and provide convective cooling of the liner guide stop 22 shown in FIGS. 1, 3 and 4, during operation of the combustor, thereby decreasing thermal and mechanical stresses on the liner guide stop 22.

As shown in FIGS. 1-4, the flow sleeve 14 may define at least one second passage 40 extending generally radially through the flow sleeve 14. The second passage 40 may be aligned substantially concentrically with the first passage 28. The second passage 40 may be generally arcuate, rectangular, triangular or any shape complementary to the liner guide stop 22 and/or the first collar 36 as shown in FIG. 2. In this manner, the liner guide stop 22 and/or the first collar 36 may extend through the flow sleeve 14. The second passage 40 may be sized to allow for thermal growth of the liner guide stop during operation of the combustor 10 and/or to allow for the removal/replacement of the liner guide stop during combustor 10 outages.

As shown in FIG. 1, a second collar 42 may be disposed generally concentrically within the second passage 40. The second collar 42 may extend generally radially through the flow sleeve 14 and may be mechanically coupled to the flow sleeve 14. For example, the second collar 42 may be welded or brazed to the flow sleeve 14. In addition or in the alternative, the second collar 42 may be inserted into the second passage 40 and allowed to float within the second passage 40. In this manner, the second collar 42 may move within the second passage 40 to allow for misalignment of the flow sleeve 14, misalignment of the liner guide stop 22, to account for variations in assembly tolerances, to allow for movement of the flow sleeve 14 and/or the liner guide stop 22 during operation of the combustor 10 and/or to reduce the mechanical stresses between the flow sleeve 14 and the liner guide stop 22.

Figure 4:
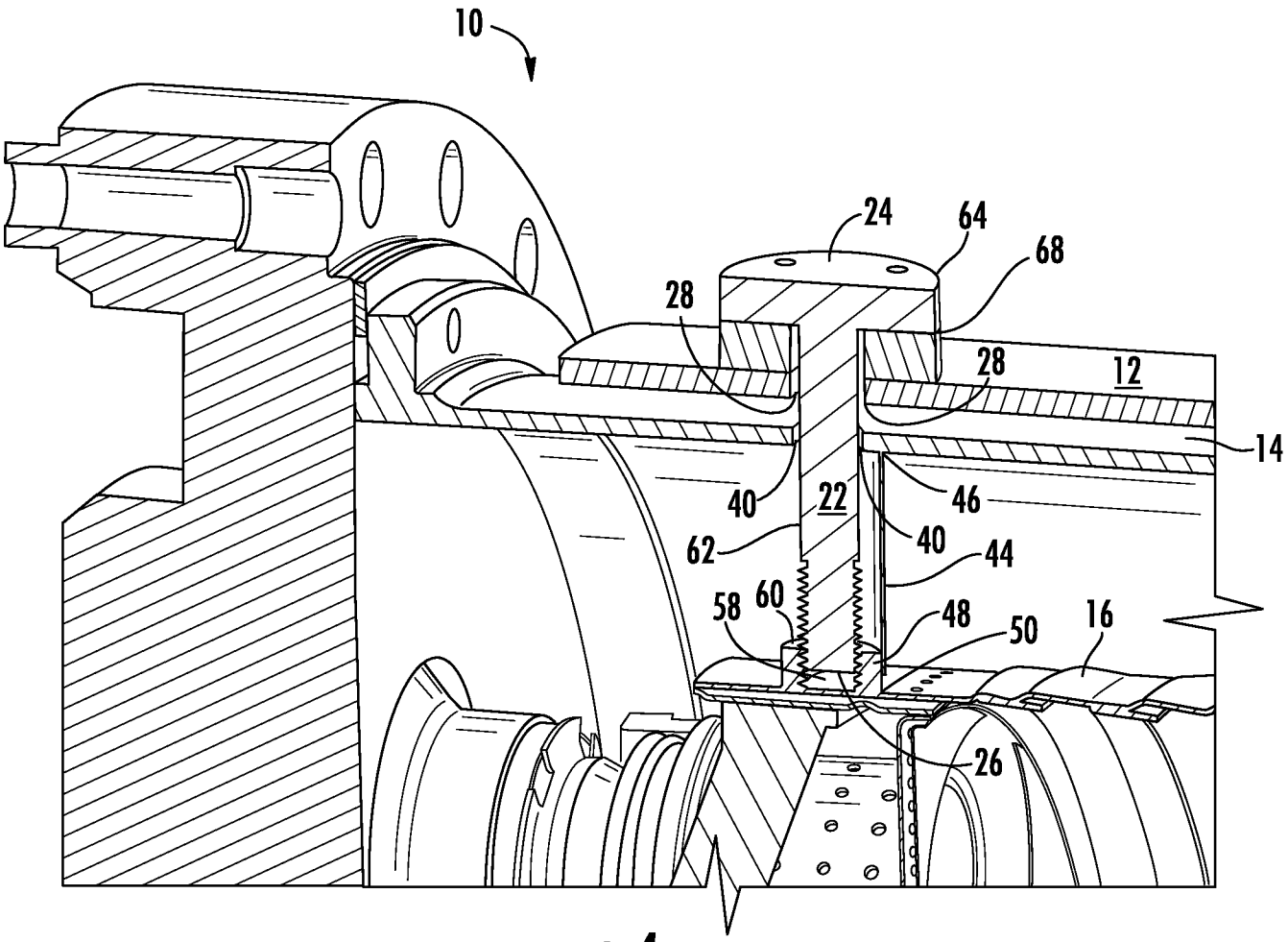
FIG. 4 illustrates a cross-sectional side view of the gas turbine combustor as shown in FIG. 1.
Figure 5:
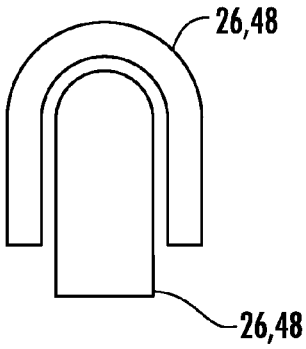
FIG. 5 illustrates a cross-sectional top view of a liner guide stop and a liner stop feature in accordance with aspects of the present subject matter.
Figure 6:
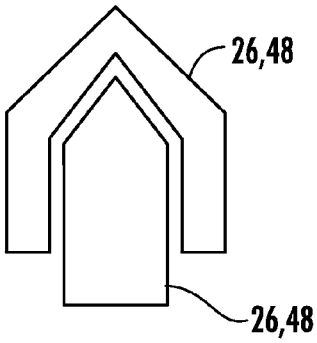
FIG. 6 illustrates a cross-sectional top view of a liner guide stop and a liner stop feature in accordance with aspects of the present subject matter.
Figure 7:
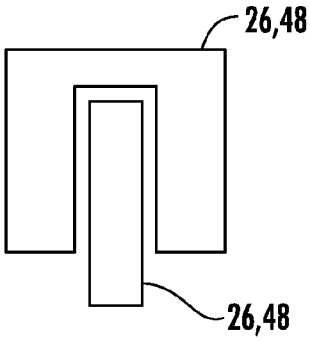
FIG. 7 illustrates a cross-sectional top view of a liner guide stop and a liner stop feature in accordance with aspects of the present subject matter.
Figure 8:
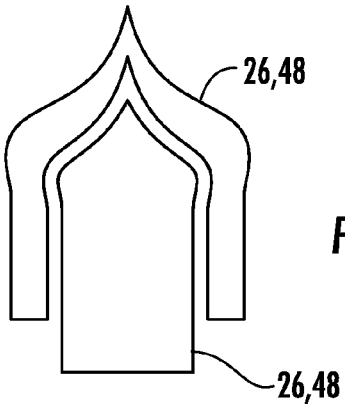
FIG. 8 illustrates a cross-sectional top view of a liner guide stop and a liner stop feature in accordance with aspects of the present subject matter.

As shown in FIG. 4, an alignment sleeve 44 may extend generally radially inward from an inner surface 46 of the flow sleeve 14 towards the combustion liner 16. It should be appreciated that the alignment sleeve 44 may be coupled to the flow sleeve 14 using any suitable means known in the art. For example, the alignment sleeve 44 may be welded, bolted, pinned, and/or cast as an integral part of the flow sleeve 14. The alignment sleeve 44 may at least partially surround the second passage 40 and/or the first collar 36 or the second collar 42, as shown in FIGS. 2 and 1 respectfully. The alignment sleeve 44 may be partially arcuate, triangular, or rectangular or any combination thereof suitable to at least partially engage and/or align the flow sleeve 14 with the combustion liner 16 during assembly and/or operation of the combustor 10.

As shown in FIGS. 1-4, the combustion liner 16 may include at least one liner stop feature 48. The liner stop feature 48 may be coupled to the combustion liner 16 and may extend generally radially outward from a cool side surface 50 of the combustion liner 16. It should be appreciated by one skilled in the art that the liner stop feature 48 may be coupled to the combustion liner 16 using any suitable means known in the art. For example, the liner stop feature 48 may be welded, pined and/or cast as an integral part of the combustion liner 16. As shown in FIGS. 1, 3 and 4, the liner stop feature 48 may be designed to have any suitable shape and/or configuration that may enable the liner stop feature 48 to mate and/or engage with the liner guide stop 22 second end 26 and/or the alignment sleeve 44 as shown in FIG. 3, so as to facilitate installation of the combustion liner 16 and/or to properly align the combustion liner 16 within the flow sleeve 14 (or combustion casing 12) and/or to prevent rotation and/or axial movement of the combustion liner 16 during operation of the combustor 10. It should be known that the term "second end" as used herein is defined as a portion of the liner guide stop 22 that at least partially engages with the liner stop feature 48. For example, as shown in FIGS. 5-8, the liner stop feature 48 may be generally arcuate, triangular, rectangular or any combination thereof suitable for engaging and/or mating with the liner guide stop 22 second end 26 as shown in FIGS. 1, 3 and 4 and/or for engaging with the alignment sleeve 44 as shown in FIG. 3. As shown in FIGS. 1, 3, 4 and 5-8, the liner stop feature 48 may be configured as male or female liner stop features 48 so as to complement the liner guide stop 22 second end 26. In particular embodiments, as shown in FIG. 3, the liner stop feature 48 may define a first elongated slot 52 configured to receive the liner guide stop second end 26 as the combustion liner 16 is inserted into the combustor 10. The first elongated slot 52 may be generally defined from a downstream end 54 of the liner stop feature 48 and may extend towards an upstream end 56 of the liner stop feature 48. In other embodiments, as shown in FIG. 4, the liner stop feature 48 may at least partially define a hole 58 extending generally radially inward from a top surface 60 of the liner stop feature 48. In particular embodiments, the hole 58 may be tapped and/or may include a threaded insert configured to engage with the liner guide stop 22 second end 26.

As seen in FIGS. 1, 3 and 4, the liner guide stop includes a support body 62 generally extending between the first end 24 and the second end 26. The support body 62 may generally extend through the casing 12 first passage 28 and the flow sleeve 14 second passage 40 so that the second end 26 at least partially engages with the liner stop feature 48 of the combustion liner 16. The support body 62 may be generally arcuate, rectangular, angled or any shape or combination of shapes suitable for supporting the combustion liner 16 during operation of the combustor 10.

In particular embodiments, the first end 24 of the liner guide stop 22 may include a flange 64 extending at least partially circumferentially around the first end 24. As shown in FIG. 1, the flange 64 may define at least one fastener passage 66 extending generally radially through the flange 64. The fastener passage 66 may be positioned so as to be aligned with the casing 12 recess 34 when the liner guide stop 22 is inserted into the combustor 10. In this manner, a fastener, such as a bolt, may pass through the flange 64 and into the casing 12 recess 34 in order to couple the liner guide stop 22 to the casing 12.

As shown in FIG. 3, in particular embodiments, the support body 62 and/or the first end 24 may be threaded. In this manner, the liner guide stop 22 may be secured directly to the casing 12 by screwing the liner guide stop 22 into the first passage 28, wherein the first passage 28 is threaded and/or includes threaded inserts disposed within the first passage 28 as previously disclosed. As shown in FIGS. 1, 3 and 4, the flange 64 may also define a second mating surface 68. The second mating surface 68 may be complementary to the first mating surface 30 of the casing 12 shown in FIG. 2, and may form a seal between the liner guide stop 22 and the casing 12 as shown in FIGS. 1, 3 and 4, once the liner guide stop 22 is coupled to the casing 12. In further embodiments, the liner guide stop 22 may be coupled to the casing 12 and/or the first mating surface 30 by welding the liner guide stop 22 to the outer surface 32 of the casing 12 and/or to the first mating surface 30. In alternate embodiments, the liner guide stop 22 may be coupled to an outer surface of the flow sleeve 14. In this manner, the support body 62 may extend through the flow sleeve 14 so that the second end 26 at least partially engages with the liner stop feature 48 of the combustion liner 16.

As shown in FIGS. 1 and 3-8, The second end 26 of the liner guide stop 22 may be any suitable shape and/or configuration that enables the liner guide stop 22 to mate and/or engage with the liner stop feature 48 so as to facilitate installation of the combustion liner 16 and/or to properly align the combustion liner 16 within the flow sleeve 14 and/or the combustor casing 12. In this manner, the liner guide stop 22 may also prevent rotation and/or axial movement of the combustion liner 16 during operation of the combustor 10. For example, as shown in FIGS. 5-8, the liner guide stop 22 may be generally arcuate, triangular, rectangular or any combination thereof suitable for engaging and/or mating with the liner stop feature 48. As shown in FIGS. 1 and 4, the liner guide stop 22 second end 26 may be configured to complement the male or female liner stop feature 48. In particular embodiments, as shown in FIG. 1, the second end 26 of the liner guide stop 22 may include a second elongated slot 70 such that the liner stop feature 48 may slide into and at least partially engage the liner guide stop 22 second end 26 as the combustion liner 16 is installed within the combustor 10. In further embodiments, as shown in FIG. 4, the second end may be generally circular and may include threads extending at least partially circumferentially around the second end 26. The threads on the second end 26 may be complementary to the threads disposed within the hole 58 of the liner stop feature 48. In this manner, the liner guide stop 22 may be screwed into the liner stop feature 48 to provide support and/or to maintain proper alignment of the combustion liner 16 during assembly and operation of the combustor 10. It should be appreciated by one skilled in the art that liner guide stop 22 may be utilized to indicate the proper installation depth of the combustion liner 16 as well as prevent rotation and/or axial movement of the combustion liner 16 during operation of the combustor 10.

The various embodiments described and illustrated with respect to FIGS. 1-8 may also provide a method for assembling the combustor 10 for a gas turbine. The method may generally include inserting the combustion liner 16, comprising at least one of the liner stop features 48, into the combustor casing 12. The method further includes inserting the liner guide stop 22 through the casing 12 and the flow sleeve 14, and engaging the second end 26 of the liner guide stop 22 with the liner stop feature 48. The method may further include coupling the first end 24 of the liner guide stop 22 to the casing 12. The method may also include coupling the liner guide stop 22 to the casing 12 by bolting or welding the liner guide stop 22 to an outer surface 32 of the casing 12. The method may further include inserting a collar (36 or 42) through at least one of the casing 12 or the flow sleeve 14 so that the collar at least partially surrounds the liner guide stop 22. The method may also include screwing the liner guide stop 22 into the liner stop feature 48. The method may further include inserting the liner stop feature 48 into the second elongated slot 70 disposed at the second end 26 of the liner guide stop 22. In addition or in the alternative, the method may include inserting the liner guide stop 22 into the first elongated slot 52 disposed within the liner stop feature 48. The method may also include aligning the liner stop feature 48 with the alignment sleeve 44 as the combustion liner 16 is inserted into the flow sleeve 14.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A method for assembling a combustor of a gas turbine, the combustor including a casing, a flow sleeve, and a combustion liner, the method comprising:

a. inserting the combustion liner into the combustor casing such that the combustion liner is concentrically arranged within the flow sleeve, the combustion liner including at least one liner stop feature extending therefrom;

b. aligning the liner stop feature with an alignment sleeve as the combustion liner is inserted into the combustor casing, the alignment sleeve coupled to the flow sleeve and extending radially inward from an inner surface of the flow sleeve;

c. inserting a liner guide stop through the casing and the flow sleeve, the liner guide stop extending between a first end and a second end; and d. engaging the second end of the liner guide stop with the liner stop feature;

e. wherein engaging the second of the liner guide stop with the liner stop feature comprises one of:

i) inserting the second end of the liner guide stop into a slot formed in the liner stop feature, wherein the slot formed in the liner stop feature opens through a downstream end of the liner stop feature;

ii) inserting the liner stop feature into a slot formed in the second end of the liner guide stop, wherein the slot formed in the second end of the liner guide stop opens through an upstream end of the second end of the liner guide stop; or iii) screwing the second end of the liner guide stop into threaded engagement with the liner stop feature.

2. The method of claim 1, further comprising coupling the first end of the liner guide stop to an outer surface of the casing.

3. The method of claim 2, wherein coupling the liner guide stop to the outer surface of the casing comprises at least one of bolting, screwing or welding the liner guide stop to the outer surface of the casing.

4. The method of claim 1, further comprising inserting a collar through at least one of the casing or the flow sleeve, wherein the collar at least partially surrounds the liner guide stop.

5. A combustor for a gas turbine comprising:

a. a casing;

b. a flow sleeve at least partially disposed within the casing, the flow sleeve having an inner surface;

c. an alignment sleeve coupled to the flow sleeve, the alignment sleeve extending radially inward from the inner surface of the flow sleeve;

d. a combustion liner at least partially disposed within the flow sleeve;

e. a liner stop feature extending from the combustion liner, the liner stop feature having an upstream end and a downstream end, the downstream end positioned adjacent the alignment sleeve; and f. a liner guide stop including a first end separated from a second end, the second end configured to be at least partially engaged with the liner stop feature, wherein the liner guide stop extends through the casing and the flow sleeve;

g. wherein the at least partial engagement of the liner stop feature with the second end of the liner guide stop comprises one of:

i) the liner stop feature being disposed in a slot formed in the second end of the liner guide stop, wherein the slot formed in the second end of the liner guide stop opens through an upstream end of the second end of the liner guide stop;

ii) the second end of the liner guide stop being disposed in a slot formed in the liner stop feature, wherein the slot formed in the liner stop feature opens through a downstream end of the liner stop feature; or iii) the second end of the liner guide stop being in threaded engagement with the liner stop feature.

6. The combustor of claim 5, wherein the alignment sleeve is at least partially arcuate, triangular or rectangular shaped.

7. A combustor for a gas turbine comprising:

a. a casing;

b. a flow sleeve at least partially disposed within the casing, the flow sleeve defining a passage extending radially through the flow sleeve;

c. a collar inserted into the passage, the collar coupled to the flow sleeve such that the collar is movable within the passage;

d. a combustion liner at least partially disposed within the flow sleeve;

e. a liner stop feature extending from the combustion liner; and f. a liner guide stop including a first end separated from a second end, the second end configured to be at least partially engaged with the liner stop feature, wherein the liner guide stop extends through the casing and the flow sleeve, and wherein the collar at least partially surrounds the liner guide stop;

g. wherein the at least partial engagement of the liner stop feature with the second end of the liner guide stop comprises one of:

i) the liner stop feature being disposed in a slot formed in the second end of the liner guide stop, wherein the slot formed in the second end of the liner guide stop opens through an upstream end of the second end of the liner guide stop;

ii) the second end of the liner guide stop being disposed in a slot formed in the liner stop feature, wherein the slot formed in the liner stop feature opens through a downstream end of the liner stop feature; or iii) the second end of the liner guide stop being in threaded engagement with the liner stop feature.

8. The combustor of claim 7, wherein the liner guide stop is coupled to an outer surface of the casing.

9. The combustor of claim 7, wherein the first end of the liner guide stop is configured to screw into a passage at least partially defined by the casing.

10. The combustor of claim 7, wherein the liner guide stop includes a flange at the first end, the flange configured to be coupled with an outer surface of the casing.

11. The combustor of claim 7, wherein the second end of the liner guide stop defines at least one of an arcuate, a triangular or a rectangular shape.

* * * * *